US007586477B2

(12) United States Patent
Lee

(10) Patent No.: US 7,586,477 B2
(45) Date of Patent: Sep. 8, 2009

(54) ACTIVE MATRIX LIQUID CRYSTAL DISPLAY

(75) Inventor: Hyun Chang Lee, Anyang-shi (KR)

(73) Assignee: LG Display Co., Ltd., Seoul (KR)

( * ) Notice: Subject to any disclaimer, the term of this patent is extended or adjusted under 35 U.S.C. 154(b) by 162 days.

(21) Appl. No.: 11/220,627

(22) Filed: Sep. 8, 2005

(65) Prior Publication Data

US 2006/0001640 A1 Jan. 5, 2006

Related U.S. Application Data

(63) Continuation of application No. 09/211,677, filed on Dec. 14, 1998, now Pat. No. 7,002,542.

(30) Foreign Application Priority Data

Sep. 19, 1998 (KR) ..... 98-38842

(51) Int. Cl.
*G09G 3/36* (2006.01)

(52) U.S. Cl. ..... 345/98; 345/94; 345/92

(58) Field of Classification Search ..... 345/87–100, 345/204

See application file for complete search history.

(56) References Cited

U.S. PATENT DOCUMENTS 4,779,956 A * 10/1988 Nemoto et al. ..... 345/96
5,151,805 A 9/1992 Takeda et al.
5,300,945 A 4/1994 Iemoto et al.
5,414,443 A 5/1995 Kanatani et al.
5,457,474 A 10/1995 Ikeda
5,587,722 A 12/1996 Suzuki et al.
5,646,643 A 7/1997 Hirai et al.
5,686,932 A 11/1997 Tomita
5,739,816 A 4/1998 Kobayashi et al.
5,754,155 A 5/1998 Kubota et al.
5,764,225 A 6/1998 Koshobu
5,784,039 A 7/1998 Yasui et al.
5,917,465 A 6/1999 Mochizuki et al.
5,949,397 A * 9/1999 Koyama et al. ..... 345/98

(Continued)

FOREIGN PATENT DOCUMENTS

EP 0320054 6/1989

(Continued)

*Primary Examiner*—Kevin M Nguyen
(74) *Attorney, Agent, or Firm*—McKenna Long & Aldridge LLP

(57) ABSTRACT

An active matrix liquid crystal display apparatus that is adaptive for eliminating a flicker and a residual image as well as simplifying the circuit configuration thereof. In the apparatus, a plurality of pixels each includes a switching transistor having a second electrode connected to a gate electrode, a first electrode and a pixel electrode. Each of pluralities of data signal lines is connected to the second electrode associated with any one of the transistors, and each of pluralities of gate signal lines is connected to the gate electrode associated with any one of the transistors. A gate driver is connected to the plurality of gate signal lines, and it receives first and second voltages and outputs any one of the first and second voltages to drive the gate signal lines sequentially. The first voltage changes prior to exciting of successive gate signal lines.

33 Claims, 16 Drawing Sheets

U.S. PATENT DOCUMENTS

| | | | |
|---|---|---|---|
| 5,995,074 | A | 11/1999 | Kusafuka et al. |
| 6,005,543 | A | 12/1999 | Kimura |
| 6,020,870 | A | 2/2000 | Takahashi et al. |
| 6,046,716 | A | 4/2000 | McKnight |
| 6,229,531 | B1 | 5/2001 | Nakajima et al. |

FOREIGN PATENT DOCUMENTS

| | | | |
|---|---|---|---|
| EP | 0500354 | A2 | 8/1992 |
| EP | 0508628 | A2 | 10/1992 |
| EP | 0574920 | | 12/1993 |
| EP | 0657864 | | 6/1995 |
| EP | 0657864 | A1 | 6/1995 |
| EP | 0780825 | | 6/1997 |
| JP | 02272490 | | 11/1990 |
| JP | 06-027899 | | 2/1994 |
| JP | 06-110035 | | 4/1994 |
| JP | 6110035 | | 4/1994 |
| JP | 9258174 | | 10/1997 |
| JP | 11-084342 | | 3/1999 |

* cited by examiner

40
LOW LEVEL GATE VOLTAGE GENERATOR
44
HIGH LEVEL VOLTAGE GENERATOR
HS
DCK
SCL
DCL
GSP
GSC
32
DATA DRIVER
VOLTAGE CONTROLLER
TIMING CONTROLLER
46
48
42
FVL
CL
GCL
SVL
34
38
36
SHIFT REGISTER
QT1
QT2
QTn-2
QTn-1
QTn
VCC
39
Rc
Cc
GL1
GL2
GLn-2
GLn-1
GLn
31
CMN
Cst
Clc
SL1
SL2
SL3
SLm-1
SLm
30

ACTIVE MATRIX LIQUID CRYSTAL DISPLAY

This application is a continuation of prior application Ser. No. 09/211,677, filed Dec. 14, 1998 now U.S. Pat. No. 7,002,542.

BACKGROUND OF THE INVENTION

1. Field of the Invention

This invention relates to an active matrix liquid crystal display, and more particularly to an active matrix liquid crystal display wherein it is provided with a device for applying a gate pulse to transistors connected to picture elements (or pixels) consisting of liquid crystals.

2. Description of the Prior Art

The conventional active matrix liquid crystal display device displays a picture by controlling the light transmissivity of liquid crystal using an electric field. As shown in FIG. 1, such a liquid crystal display device includes a data driver 12 for driving signal lines SL1 to SLm at a liquid crystal panel 10, and a gate driver 14 for driving gate lines GL1 to GLn at a liquid crystal panel 10. In the liquid crystal panel 10, pixels 11 connected to signal lines SL and gate lines GL are arranged in an active matrix pattern. Each pixel 11 includes a liquid crystal cell Clc for responding to a data voltage signal DVS from the signal line SL to control a transmitted light quantity, and a thin film transistor (TFT) CMN for responding to a scanning signal SCS from the gate line GL to switch the data voltage signal DVS to be applied from the signal line SL to the liquid crystal cell Clc. As the gate lines GL1 to GLn are sequentially driven, the data driver 12 applies the data voltage signal DVS to all the signal lines SL1 to SLm. The gate driver 14 allows the gate lines GL1 to GLn to be sequentially enabled for each horizontal synchronous interval by applying the scanning signal SCS to the gate lines GL1 to GLn sequentially. To this end, the liquid crystal display device includes a shift register 16 responding to a gate start pulse from a control line CL and a gate scanning clock GSC from a gate clock line GCL, and a level shifter 18 connected between the shift register 16 and the gate lines GL1 to GLn. The shift register 16 outputs the gate start pulse GSC from the control line CL to one of n output terminals QT1 to GTn and, at the same time, responds to the gate scanning clock GSC to shift the gate start pulse GSP from the first output terminal QT1 to the nth output terminal QTn sequentially. The level shifter 18 generates n scanning signals SCS by shifting voltage levels of the output signals of the shift register 16. To this end, the level shifter 18 consists of n inverters 19 that are connected between the n output terminals QT1 to QTn of the shift register 16 and the n gate lines GL respectively, and are fed with low and high level gate voltages Vgl and Vgh in a direct current shape from first and second voltage line FVL and SVL respectively. The inverters 19 selectively supply any one of the low and high level gate voltages Vgl and Vgh to the gate line GL in accordance with a logical state at the output terminal QT of the shift register 16. Accordingly, only one of the n scanning signals SCS has the high-level gate voltage Vgh. In this case, the TFT CMN receiving a scanning signal SCS having the high level gate voltage Vgh from the gate line GL is turned on and the liquid crystal cell Clc charges the data voltage signal DVS during an interval when the TFT CMN is turned on. The voltage charged into the liquid crystal cell Clc in this manner drops when the TFT CMN is turned off and therefore becomes lower than the voltage of the data voltage signal DVS. Accordingly, a feed through voltage ΔVp corresponding to a difference voltage between the voltage charged in the liquid crystal cell and the data voltage signal DVS is generated. This feed through voltage ΔVp is caused by a parasitic capacitance existing between the gate terminal of the TFT CMN and the liquid crystal cell Clc and which changes a transmitted light quantity at the liquid crystal cell Clc periodically. As a result, a flicker and a residual image are generated in the picture displayed on the liquid crystal panel.

In order to suppress such a feed through voltage ΔVp, as shown in FIG. 1, support capacitors Cst are connected, in parallel, to the liquid crystal cells. The support capacitor Cst compensates for the liquid crystal cell voltage when the TFT CMN is turned off, thereby suppressing the feed through voltage ΔVp as expressed in the following formula:

$$\Delta Vp = \frac{(Von - Voff) \cdot Cgs}{Clc + Cst + Cgs} \tag{1}$$

in which Von represents a voltage at the gate line GL upon turning-on of the TFT CMS; Voff represents the voltage at the gate line GL upon turning-off of the TFT CMS; and Cgs represents the capacitance value of a parasitic capacitor existing between the gate terminal of the TFT CMN and the liquid crystal cell. As seen from the formula (1), the feed through voltage ΔVp increases depending on a voltage difference at the gate line GL upon turning-on and turning off of the TFT CMN. In order to suppress the feed through voltage ΔVp sufficiently, the capacitance value of the support capacitor CSt must be increased. This causes apertures of pixels to be increased, so that it is impossible to obtain a sufficient display contrast. As a result, it is difficult to suppress the feed through voltage ΔVp sufficiently by means of the support capacitor Cst.

As another alternative for suppressing the feed through voltage ΔVp, there has been suggested a liquid crystal display device adopting a scanning signal control system for allowing the falling edge of the scanning signal SCS to have a gentle slope. In the liquid crystal display device of scanning signal control system, the falling edge of the scanning signal SCS changes in the shape of a linear function as shown in FIG. 2A, an exponential function as shown in FIG. 2B, or a ramp function as shown in FIG. 2C. Examples of such a liquid crystal display device of scanning signal control system are disclosed in the Japanese Patent Laid-open Gazette Nos. 1994-110035 and 1997-258174 and the U.S. Pat. No. 5,587,722. However, these liquid crystal display devices of scanning signal control system additionally require circuit modification of the gate driver or a new waveform modifying circuit to be positioned between the gate driver and each gate line at the liquid crystal panel.

For example, as shown in FIG. 3, the liquid crystal display device of the scanning signal control system disclosed in the Japanese Patent Laid-open Gazette No. 1994-110035 includes an integrator 22 connected between a scanning driver cell 20 and a gate line GL. The integrator 22 consists of a resistor R1 between the scanning driver cell 20 and the gate line GL, and a capacitor C1 connected between the gate line GL and the ground voltage line GVL. The integrator 22 integrates a scanning signal SCS to be applied from the gate driver cell 20 to the gate line GL, thereby changing the falling edge of the scanning signal SCS into the shape of an exponential function. A TFT CMN included in a pixel 11 is turned on until a voltage of the scanning signal SCS from the gate line GL drops less than its threshold voltage. Although electric charges charged in a liquid crystal cell Clc are pumped into the gate line GL, sufficient electric charges are charged into the liquid crystal cell Clc by a data voltage signal DVS passing through the TFT CMN from a signal line SL. Therefore, the voltage charged in the liquid crystal cell Clc does not drop. When a voltage of the scanning signal SCS on the gate line GL drops down under the threshold voltage of the TFT CMN, the voltage variation swing is less than the threshold voltage of the TFT CMN. Thus, an electric charge amount pumped from the liquid crystal cell Clc into the gate line GL becomes very small. As a result, the feed through voltage ΔVp can be suppressed sufficiently.

In the liquid crystal display device of the scanning signal control system as described above, the feed through voltage ΔVp is sufficiently suppressed to reduce flickering and residual images considerably but since a waveform modifying circuit such as an integrator for each gate line must be added, the circuit configuration thereof becomes very complex. Further, because the rising edge of the scanning signal also changes slowly due to the waveform modifying circuit, the charge initiation time at the liquid crystal cell is delayed.

Meanwhile, the U.S. Pat. No. 5,587,722 discloses a shift register selectively receiving power supply voltages VVDD and VVDD·R1/(R1+R2), as shown in FIG. 18. The shift register responds to the power supply voltages VVDD and VVDD·R1/(R1+R2) and generates a stepwise pulse. However, the shift register must be driven at a high voltage because the power supply voltage VVDD is equal to a high-level gate voltage to be applied to gate lines on the liquid crystal display panel. In the other word, inverters included in the shift register operate at about 25 V of the driving voltage. Due this end, the active matrix liquid crystal display device disclosed in U.S. Pat. No. 5,587,722 consumes a large amount of power.

SUMMARY OF THE INVENTION

Accordingly, it is an object of the present invention to provide a liquid crystal display apparatus and method that is adapted to eliminate flickering and residual images as well as to simplify the circuit configuration thereof.

In order to achieve this and other objects of the invention, a liquid crystal display apparatus according to one aspect of the present invention includes a plurality of pixels including switching transistors each having a gate electrode, a first electrode and second electrode connected to a pixel electrode; a plurality of data signal lines connected to the second electrode associated with any one of the transistors; a plurality of gate signal lines connected to the gate electrode associated with any one of the transistors; and a gate driver connected to the plurality of gate signal lines, the gate driver receiving first and second voltages and outputting any one of the first and second voltages in such a manner to drive the gate signal lines sequentially, the first voltage changing prior to exciting of successive gate signal lines.

A method of driving a liquid crystal display apparatus according to another aspect of the present invention includes the steps of inputting a first voltage and a periodically changing second voltage; supplying the second voltage, via a switching device, to the gate line; and supplying the first voltage, via the switching device, to the gate line, the switching device being controlled by the shift register, wherein a minimum value of the second voltage is higher than a maximum value of the first voltage.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 4:
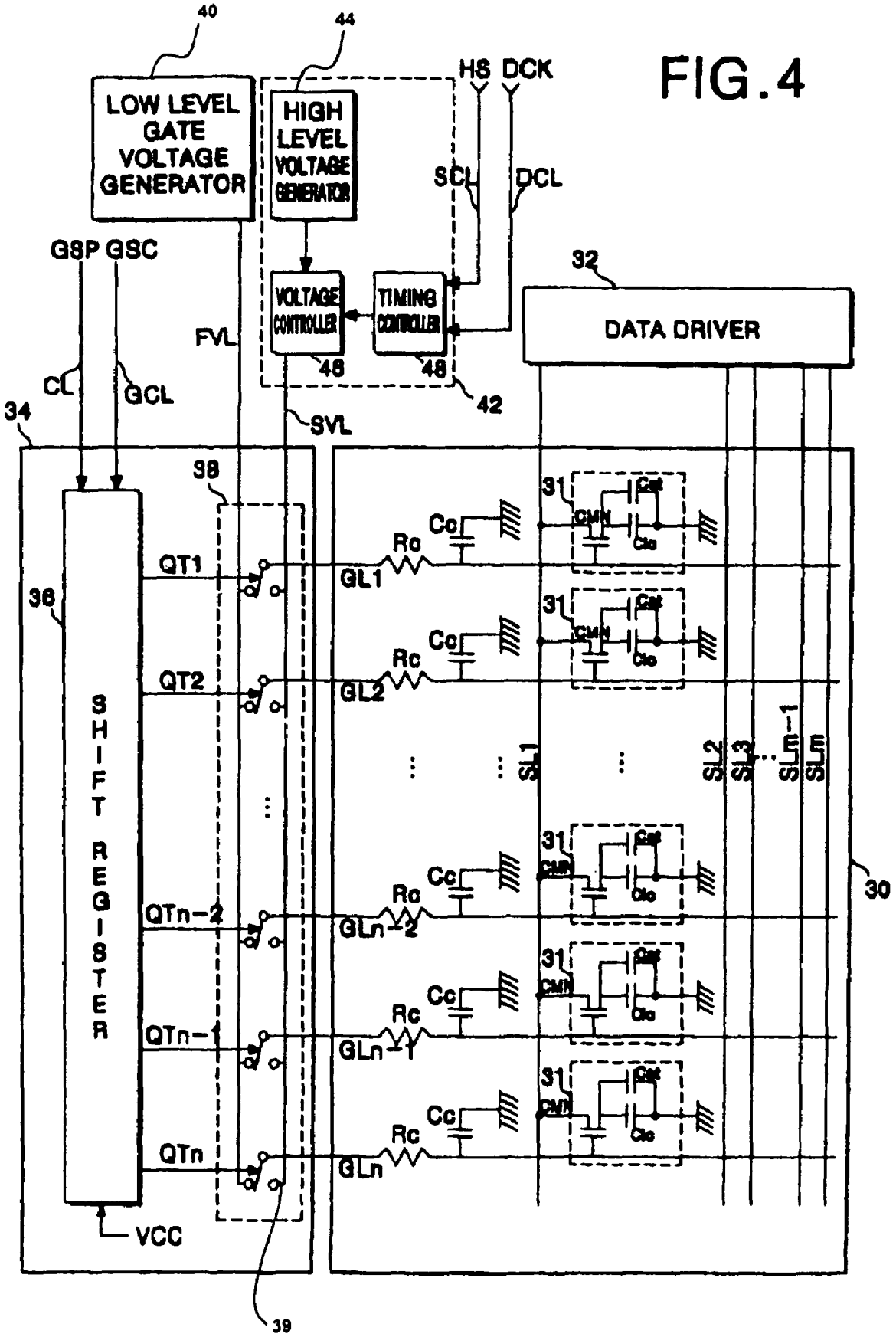
FIG. 4 is a schematic view showing the configuration of a liquid crystal display device according to an embodiment of the present invention.

Referring to FIG. 4, there is shown an active matrix liquid crystal display device according to an embodiment of the present invention that includes a data driver 32 for driving signal lines SL1 to SLm at a liquid crystal panel 30, and a gate driver 34 for driving gate lines GL1 to GLn at a liquid crystal panel 30. In the liquid crystal panel 30, pixels 31 connected to signal lines SL and gate lines GL are arranged in an active matrix pattern. Each pixel 31 includes a liquid crystal cell Clc for responding to a data voltage signal DVS from the signal line SL to control a transmitted light quantity, and a thin film transistor (TFT) CMN for responding to a scanning signal SCS from the gate line GL to switch the data voltage signal DVS to be applied from the signal line SL to the liquid crystal cell Clc. Also, Each pixel 31 has a support capacitor Cst connected, in parallel, to the liquid crystal cell Clc. This support capacitor Cst serve to buff a voltage charged in the liquid crystal cell Clc. As the gate lines GL1 to Gln are sequentially driven, the data driver 32 applies the data voltage signal DVS to all the signal lines SL1 to SLm. The gate driver 34 allows the gate lines GL1 to GLn to be sequentially enabled for each horizontal synchronous interval by applying the scanning signal SCS to the gate lines GL1 to GLn sequentially. To this end, the liquid crystal display device includes a shift register 36 responding to a gate start pulse GSP from a control line CL and a gate scanning clock GSC from a gate clock line GCL, and a level shifter 38 connected between the shift register 36 and the gate lines GL1 to GLn. The shift register 36 outputs the gate start pulse GSC from the control line CL to any one of n output terminals QT1 to QTn and, at the same time, responds to the gate scanning clock GSC to shift the gate start pulse GSP from the first output terminal QT1 to the nth output terminal QTn sequentially. Also, the shift register 16 operates at an integrated circuit driving voltage VCC having 5 V corresponding to a logical voltage level. The level shifter 38 generates n scanning signals SCS by shifting voltage levels of the output signals of the shift register 36. To this end, the level shifter 38 includes n control switches 39 connected between the n output terminal QT1 to QTn of the shift register 16 and the n gate lines GL respectively to switch low and high level gate voltages Vgl and Vgh from first and second voltage lines FVL and SVL respectively. The control switch 39 selectively delivers any one of the low and high level gate voltages Vgl and Vgh to the gate line GL in accordance with a logical state at the output terminal QT of the shift register 16. Accordingly, only any one of the n scanning signals SCS has the high level gate voltage Vgh. In this case, the TFT CMN at the gate line GL supplied with the high level gate voltage Vgh is turned on and thus the liquid crystal cell Clc charges the data voltage signal DVS during an interval when the TFT CMN is turned on. Each control switch 39 may be replaced by a buffer in which the low and high level gate voltages Vgl and Vgh is its operation voltage.

Figure 1:
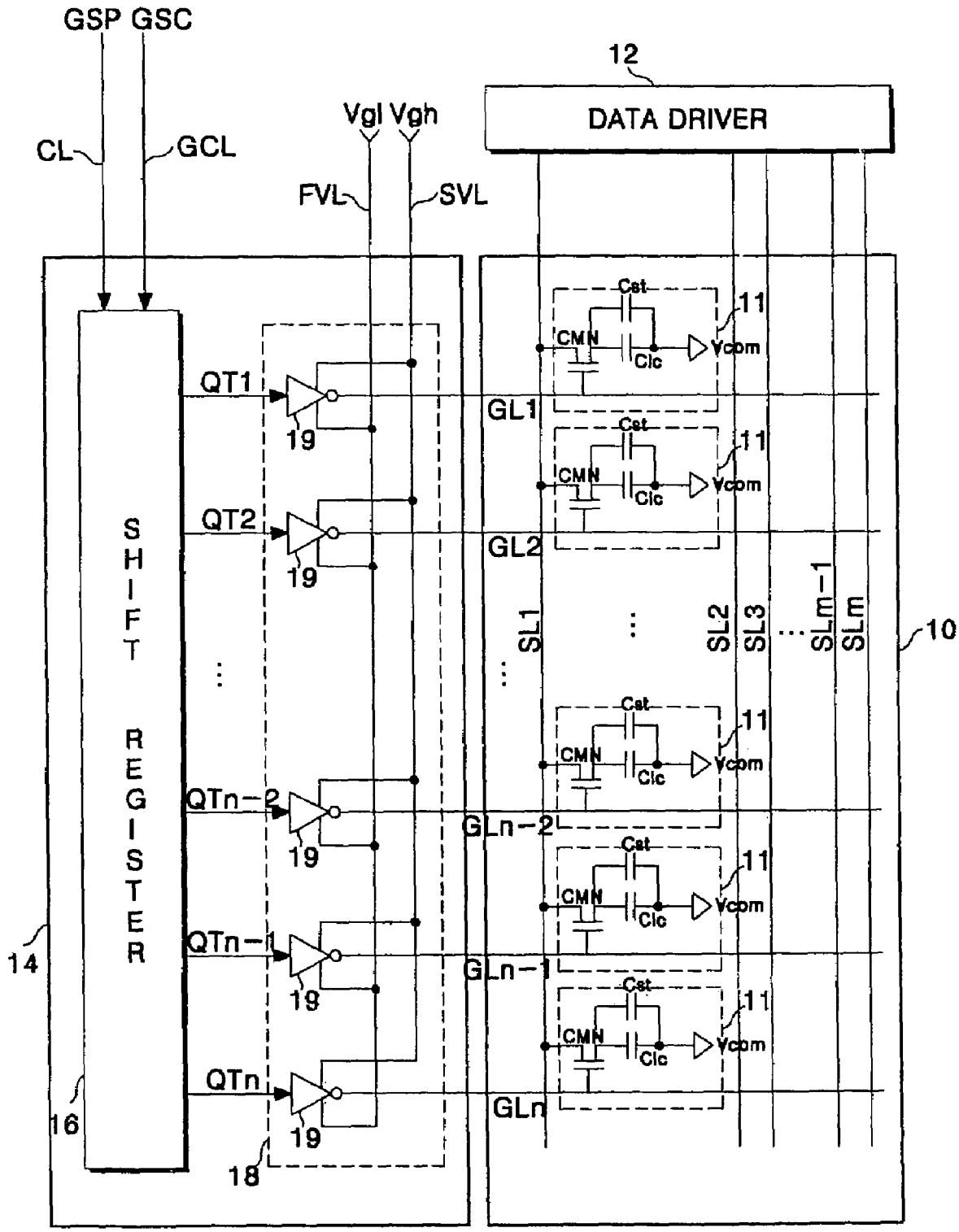
FIG. 1 PRIOR ART
FIG. 1 is a schematic view showing the configuration of a conventional liquid crystal display device.
Figure 2A:
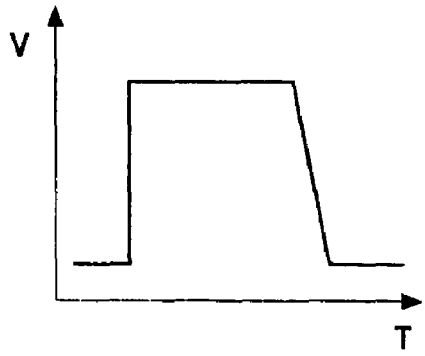
FIG.2A PRIOR ART
FIGS. 2A to 2C are waveform diagrams of a scanning signal having the falling edge changed slowly.
Figure 2B:
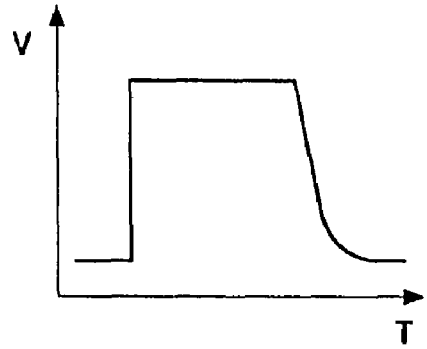
FIG.2B PRIOR ART
Figure 2C:
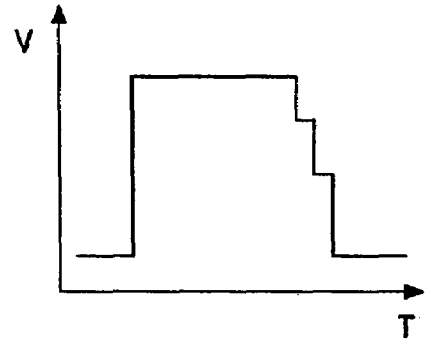
FIG.2C PRIOR ART
Figure 3:
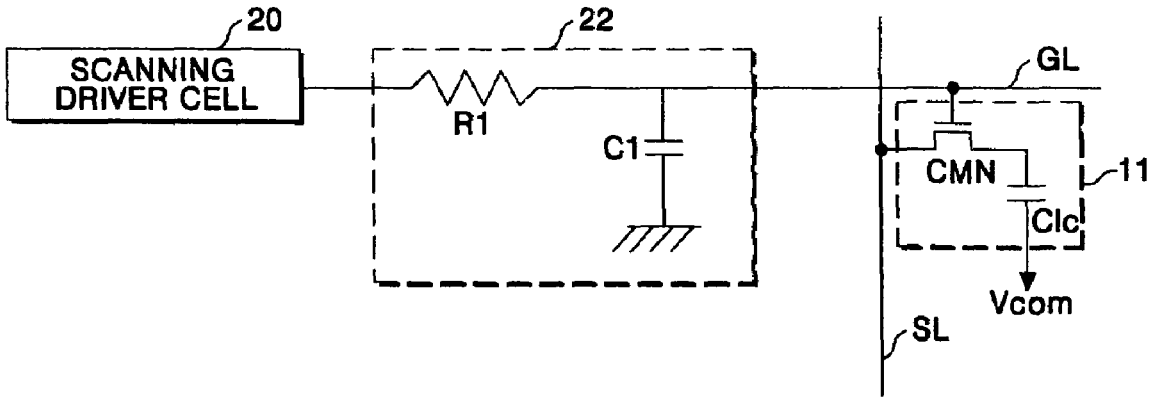
FIG.3 PRIOR ART
FIG. 3 shows a conventional liquid crystal display device employing the scanning signal in FIG. 2B.

The active matrix liquid crystal display device according to an embodiment of the present invention further includes a low level gate voltage generator 40 connected to the first voltage line FVL, and a high level gate voltage generator 42. The low level gate voltage generator 40 generates a low level gate voltage Vgl maintaining a constant voltage level and supplies it to the n control switches 39 connected to the first voltage line FVL. The low level gate voltage Vgl generated at the low level voltage generator 40 may have a shape of alternating current signal such as a certain period of pulse signal. The high level gate voltage generator 42 generates a high level gate voltage Vgh changing in a predetermined shape every period of horizontal synchronous signal such as an alternating current signal. The high level gate voltage Vgh has a falling edge changing gradually slowly. The falling edge of the high level gate voltage Vgh is changed into the shape of a linear function as shown in FIG. 2A, an exponential function as shown in FIG. 2B, or a ramp function as shown in FIG. 2C. In order to generate such a high level gate voltage Vgh, the high level gate voltage generator 42 includes a high level voltage generator 44 for generating a high level voltage, a voltage controller 46 connected between the high level voltage generator 44 and the second voltage line SVL, and a timing controller for controlling a level control time of the voltage controller 46. The high level voltage generator 44 supplies a high level voltage VDD in the shape of direct current maintaining a constant voltage level stabbly to the voltage controller 46. The voltage controller 46 periodically delivers the high level voltage VDD to the n control switches 39 connected to the second voltage line SVL and, at the same time, allows a voltage supplied to the second voltage line SVL to be lowered into any one of the function shapes as shown in FIGS. 2A to 2C. In order to change the falling edge of the voltage signal at the second voltage line SVL slowly, the voltage controller 46 may make use of a parasitic resistor Rp and a parasitic capacitor Cp existing in the gate line GL of the liquid crystal panel 30. The timing controller 48 responds to a horizontal synchronous signal HS from a synchronization control signal HCL and a data clock DCLK from a data clock line DCL to determine a voltage switching time and a voltage control time of the voltage controller 46. To this end, the timing controller 48 may include a counter (not shown) that is initialized by the horizontal synchronous signal HS and counts the data clock DCLK, and a logical combiner (not shown) for logically combining output signals of the counter to control the voltage controller 46.

As described above, since the high level gate voltage Vgh at the second voltage line SVL has a falling edge changing into the alternating current shape and decreasing slowly, the falling edge of the scanning signal SCS applied to the gate line GL of the liquid crystal panel 30 changes slowly. The TFT CMN included in the pixel 31 is turned on until a voltage of the scanning signal SCS from the gate line GL drops less than its threshold voltage. At this time, Although electric charges charged in a liquid crystal cell Clc are pumped into the gate line GL, sufficient electric charges are charged into the liquid crystal cell Clc by a data voltage signal DVS passing through the TFT CMN from a signal line SL. Accordingly, the voltage charged in the liquid crystal cell Clc does not drop. Then, since a voltage variation amount on the gate line GL is a threshold voltage of the TFT CMN in maximum when the voltage of the scanning signal SCS on the gate line GL drops down under the threshold voltage of the TFT CMN, a electric charge amount pumped from the liquid crystal cell Clc into the gate line GL becomes very small. As a result, a feed through voltage ΔVp can be suppressed sufficiently.

Figure 5:
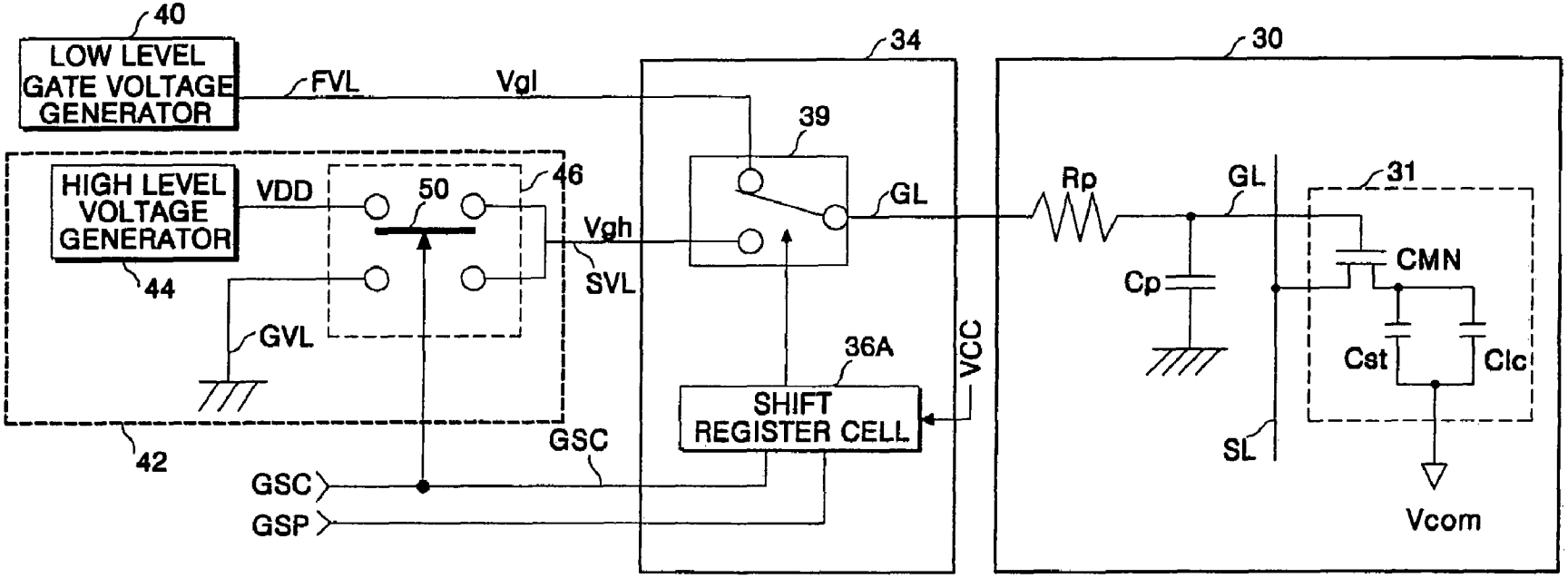
FIG. 5 is a schematic view showing the configuration of a liquid crystal display device according to another embodiment of the present invention.
Figure 6:
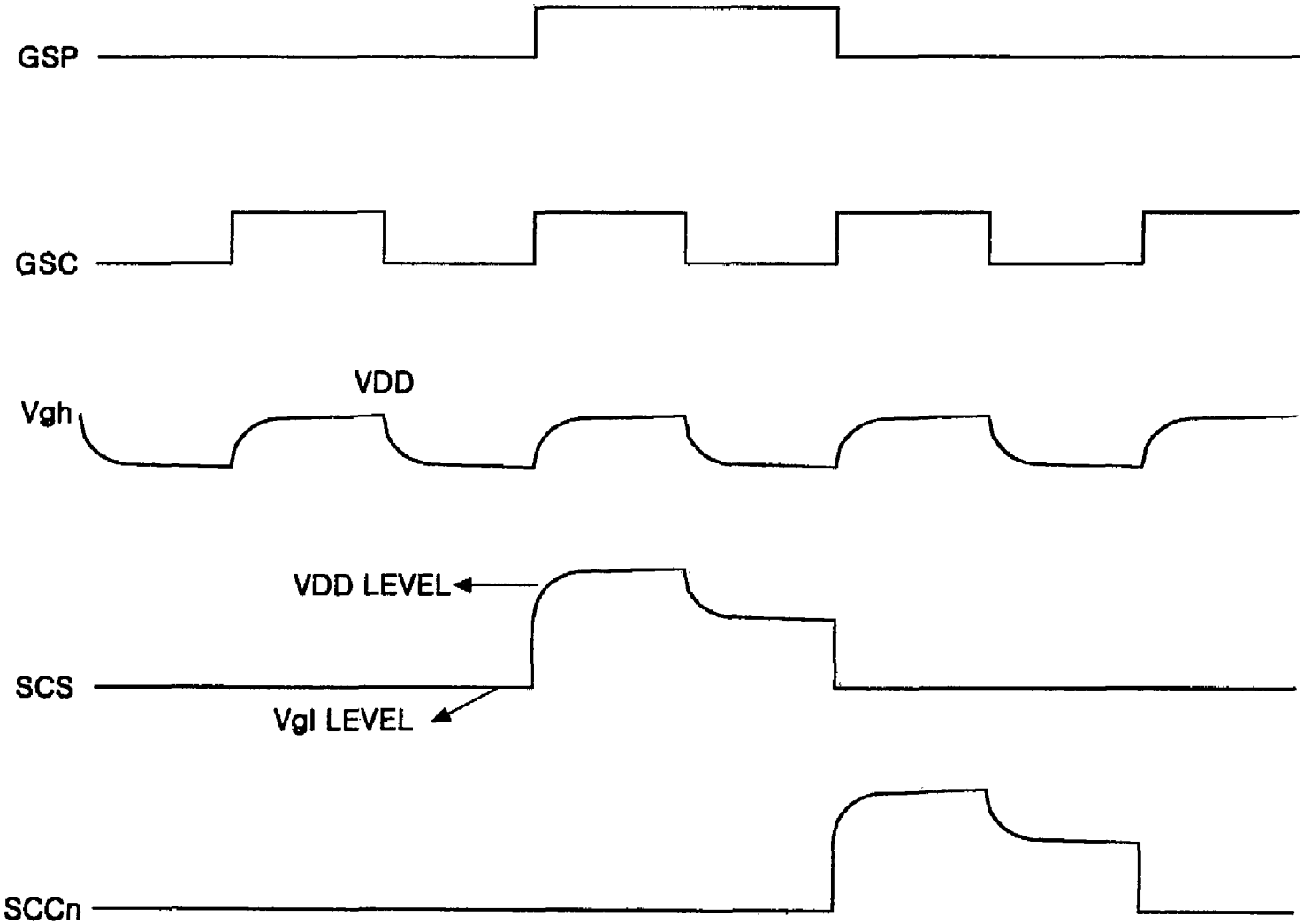
FIG. 6 is output waveform diagrams of each part of the liquid crystal display device shown in FIG. 5.

Referring now to FIG. 5, there is shown an active matrix liquid crystal display device according to another embodiment of the present invention. In the active matrix liquid crystal display device, a voltage controller 46 makes use of a parasitic resistor Rp and a parasitic capacitor Cp at a gate line GL to change the falling edge of a high level gate voltage Vgh and the falling edge of a scanning signal SCS into an exponential function shape. A liquid crystal panel 30 includes a pixel 31 connected to a signal line SL and the gate line GL. The pixel 31 includes a liquid crystal cell Clc for responding to a data voltage signal DVS from the signal line SL to control a transmitted light quantity, and a TFT CMN for responding to a scanning signal SCS from the gate line GL to switch the data voltage signal DVS to be applied from the signal line SL to the liquid crystal cell Clc. Also, the pixel 31 has a support capacitor Cst connected, in parallel, to the liquid crystal cell Clc. A gate driver 34 includes a shift register cell 36A responding to a gate start pulse GSP from a control line CL and a gate scanning clock GSC from a gate clock line GCL, and a control switch 39 connected between the shift register cell 36A and the gate line GL. The shift register cell 36A outputs the gate start pulse GSP outputs the gate start pulse GSP as shown in FIG. 6 at the rising edge of the gate scanning clock GSC as shown in FIG. 6 to an output terminal QT. The control switch 39 selectively delivers any one of the low and high level gate voltages Vgl and Vgh to the gate line GL in accordance with a logical state at the output terminal QT of the shift register cell 36A. Accordingly, a scanning signal SCS having the low level gate voltage Vgl or the high level gate voltage Vgh emerges at the gate line GL. More specifically, the control switch 39 allows the high level gate voltage Vgh to be supplied to the gate line GL when an output signal of the shift register cell 36A has a high logic; while it allows the low level gate voltage Vgl to be supplied to the gate line GL when an output signal of the shift register cell 36A has a low logic. A signal "SCSn" in FIG. 6 represents a waveform of a scanning signal applied to the next gate line.

The active matrix liquid crystal display device according to another embodiment of the present invention further includes a low level gate voltage generator 40 connected to the first voltage line FVL, and a high level gate voltage generator 42. The low level gate voltage generator 40 generates a low level gate voltage Vgl maintaining a constant voltage level and supplies it to the n control switches 39 connected to the first voltage line FVL. The high level gate voltage generator 42 generates a high level gate voltage Vgh changing periodically as shown in FIG. 6. The falling edge of the high level gate voltage Vgh drops slowly in an exponential function shape. In order to generate such a high level gate voltage Vgh, the high level gate voltage generator 42 includes a high level voltage generator 44 for generating a high level voltage, and a voltage controller 46 connected between the high level voltage generator 44 and the second voltage line SVL. The high level voltage generator 44 supplies a high level voltage VDD in the shape of direct current maintaining a constant voltage level stabbly to the voltage controller 46. The voltage controller 46 alternately couples the second voltage line SVL with the high level voltage generator 44 and the ground voltage line GVL, thereby generating the high level gate voltage Vgh as shown in FIG. 6 at the second voltage line SVL. To this end, the voltage controller 46 includes a two-contact control switch 50 for responding to a gate scanning clock GSC. The two-contact control switch 50 connects the second voltage line SVL to the high level voltage generator 44 at a high logic region of the gate scanning clock GSC, so that a high level voltage VDD emerges at the second voltage line SVL and the gate line GL. When the gate scanning clock GSC transits from a high logic into a low logic, the two-contact control switch 50 connects the second voltage line SVL to a ground voltage line GVL, thereby dropping a voltage at the second voltage line SVL and the gate line GL from the high level VDD in the exponential function shape. At this time, the voltage at the second voltage line SVL and the gate line GL is discharged into the ground voltage line in accordance with a time constant of the parasitic resistor Rp and the parasitic capacitor Cp, thereby slowly changing the falling edges of the high level gate voltage Vgh and the scanning signal SCS in an exponential function shape as shown in FIG. 6. Accordingly, the TFT CMN included in the pixel 31 is turned on until a voltage of the scanning signal SCS from the gate line GL drops less than its threshold voltage. At this time, although electric charges charged in a liquid crystal cell Clc are pumped into the gate line GL, sufficient electric charges are charged into the liquid crystal cell Clc by a data voltage signal DVS passing through the TFT CMN from a signal line SL. Accordingly, the voltage charged in the liquid crystal cell Clc does not drop. Then, since a voltage variation amount in the gate line GL is the threshold voltage of the TFT CMN in maximum when a voltage of the scanning signal SCS at the gate line GL drops down under the threshold voltage of the TFT CMN, a electric charge amount pumped from the liquid crystal cell Clc into the gate line GL becomes very small. As a result, a feed through voltage Δ Vp can be suppressed sufficiently. Furthermore, flickering and residual images does not appear at a picture displayed with the pixel 31.

Figure 7:
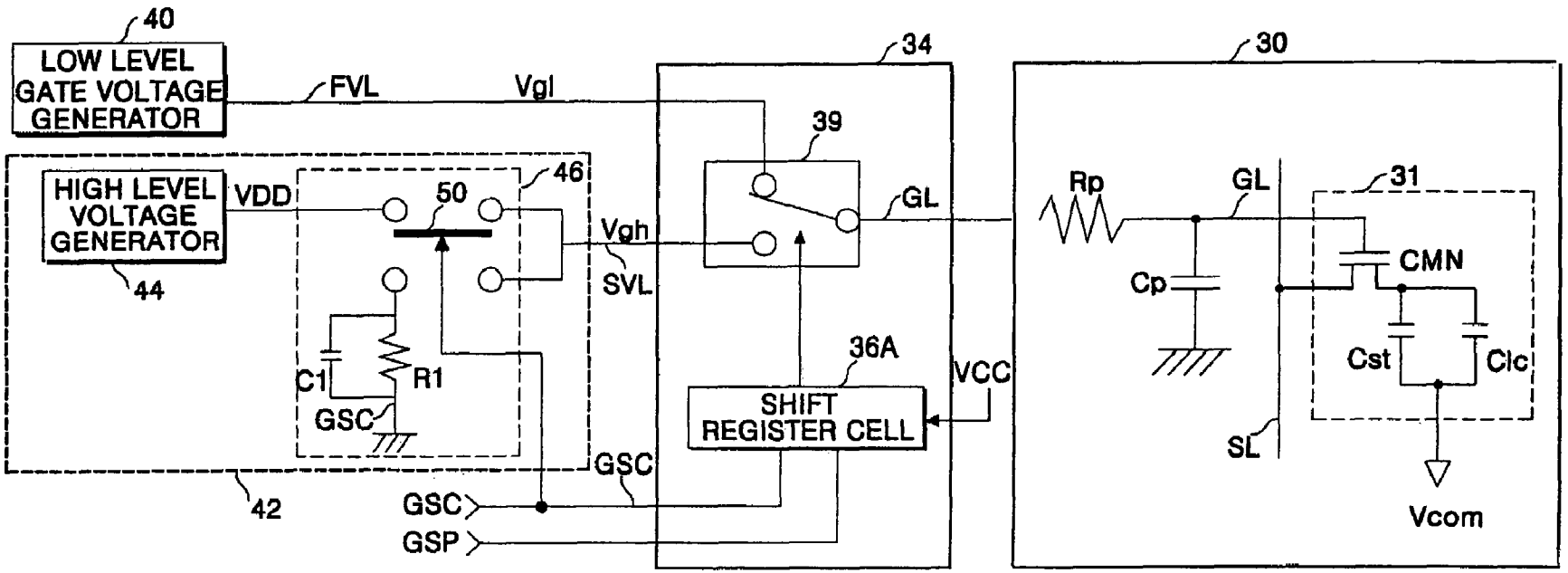
FIG. 7 is a schematic view showing the configuration of a liquid crystal display device according to still another embodiment of the present invention.
Figure 8:
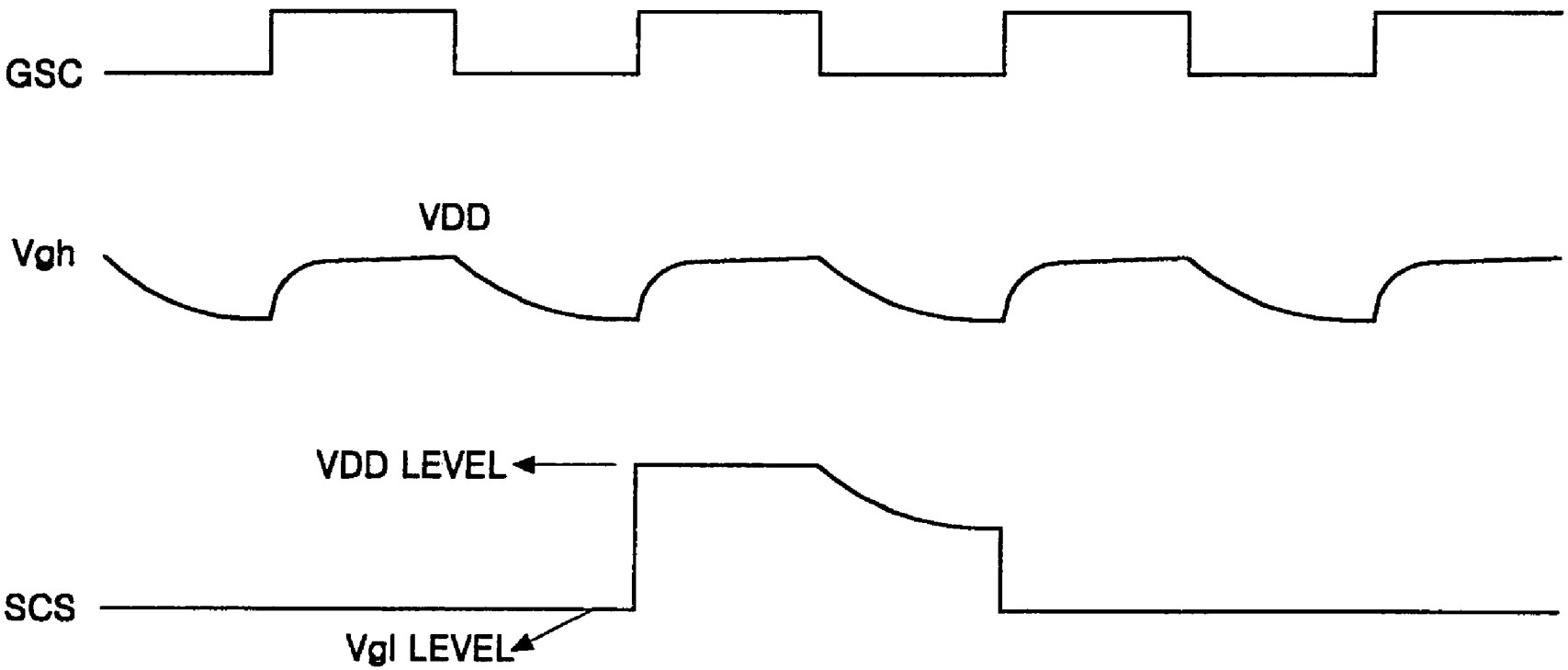
FIG. 8 is waveform diagrams of a high-level gate voltage and a scanning signal.

Referring to FIG. 7, there is shown an active matrix liquid crystal display device according to still another embodiment of the present invention. The active matrix liquid crystal display device of FIG. 7 has the same circuit configuration similar as that of FIG. 5 except that a voltage controller 46 further includes a parallel connection of a resister R1 and a capacitor C1 between the two-contact control switch 50 and the ground voltage line GVL. The resistor R1 and the capacitor C1 increases a time constant when a voltage at a second voltage line SVL and a gate line GL is discharged into the ground voltage line GVL. Accordingly, the falling edge of a high level gate voltage Vgh at the second voltage line SVL has a slower slope than the rising edge thereof as shown in FIG. 8. Only any one of the resistor R1 and the capacitor C1 may be used as needed. The falling edges of the high level gate voltage Vgh and the scanning signal SCS are controlled more slowly than the rising edges thereof as described above, so that the liquid crystal display device can suppress a feed through voltage ΔVp sufficiently and have a rapid response speed.

Figure 9:
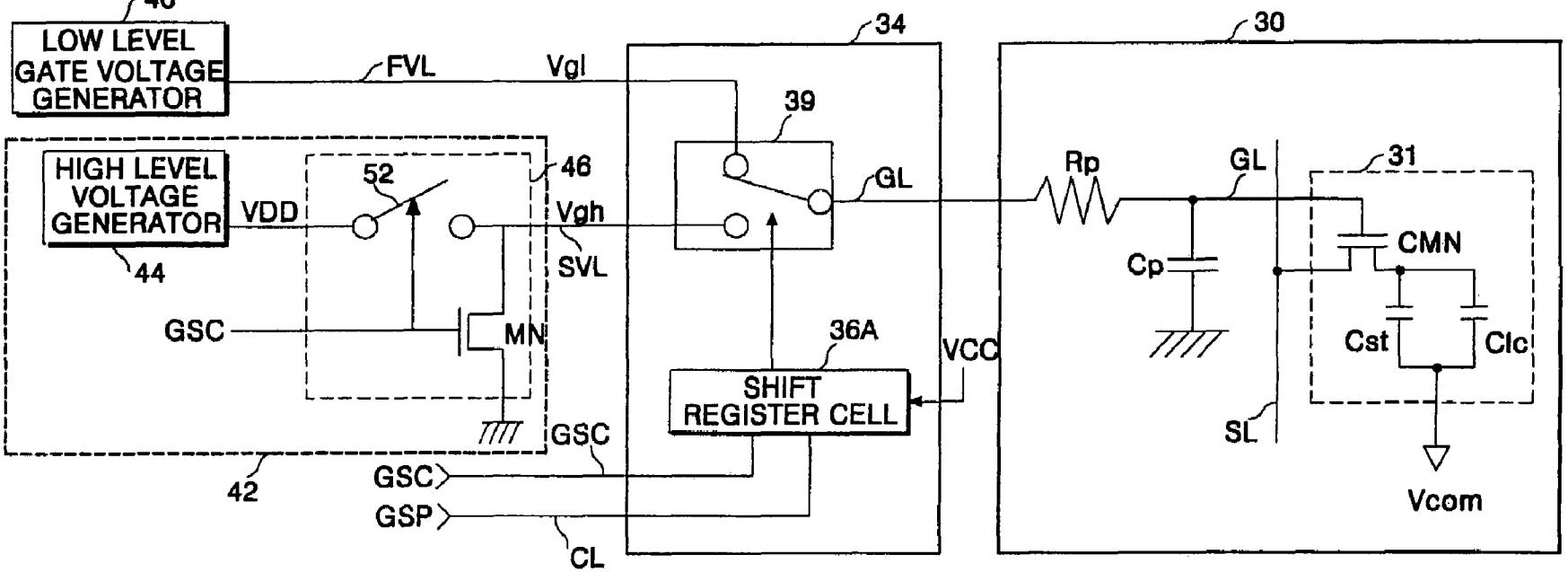
FIG. 9 is a schematic view showing the configuration of a liquid crystal display device according to still another embodiment of the present invention.

Referring now to FIG. 9, there is shown an active matrix liquid crystal display device according to still another embodiment of the present invention. The active matrix liquid crystal display device of FIG. 9 has the same circuit configuration similar as that of FIG. 5 except that a voltage controller 46 further includes a one-contact control switch 52 connected between the high level voltage generator 44 and the second voltage line SVL instead of the two-contact control switch 50, and a TFT MN connected between the second voltage line SVL and the ground voltage line GVL. The one-contact control switch 52 and the TFT MN is complementarily turned on in accordance with a logical state of a gate scanning clock GSC. More specifically, the one-contact control switch 52 is turned on during an interval when the gate scanning clock GSC remains at a high logic; while the TFT MN is turned on during an interval when the gate scanning clock GSC remains at a low logic. The TFT MN provides a discharge path with the second voltage line SVL and the gate line GL with the aid of the gate scanning clock GSC, thereby changing the falling edges of the high level gate voltage Vgh and the scanning signal SCS into an exponential function shape. Also, the TFT MN increases a time constant with the aid of a resistor component and a capacitor component occurring upon its turning-on when voltages at a second voltage line SVL and a gate line GL are discharged into the ground voltage line GVL. Accordingly, the falling edge of the high level gate voltage Vgh at the second voltage line SVL has a slower slope than the rising edge thereof as shown in FIG. 8. Also, the falling edge of the scanning signal SCS at the gate line GL changes more slowly than the rising thereof as shown in FIG. 8. The falling edges of the high level gate voltage Vgh and the scanning signal SCS are controlled more slowly than the rising edges thereof as described above, so that the liquid crystal display device can suppress a feed through voltage ΔVp sufficiently and have a rapid response speed. The TFT MN has a suitable channel width in such a manner that a resistance value of the resistor component and a capacitance value of the capacitor component are set appropriately. Furthermore, a resistor and/or a capacitor for slightly increasing a time constant may be added between the TFT MN and the ground voltage line GVL.

Figure 10:
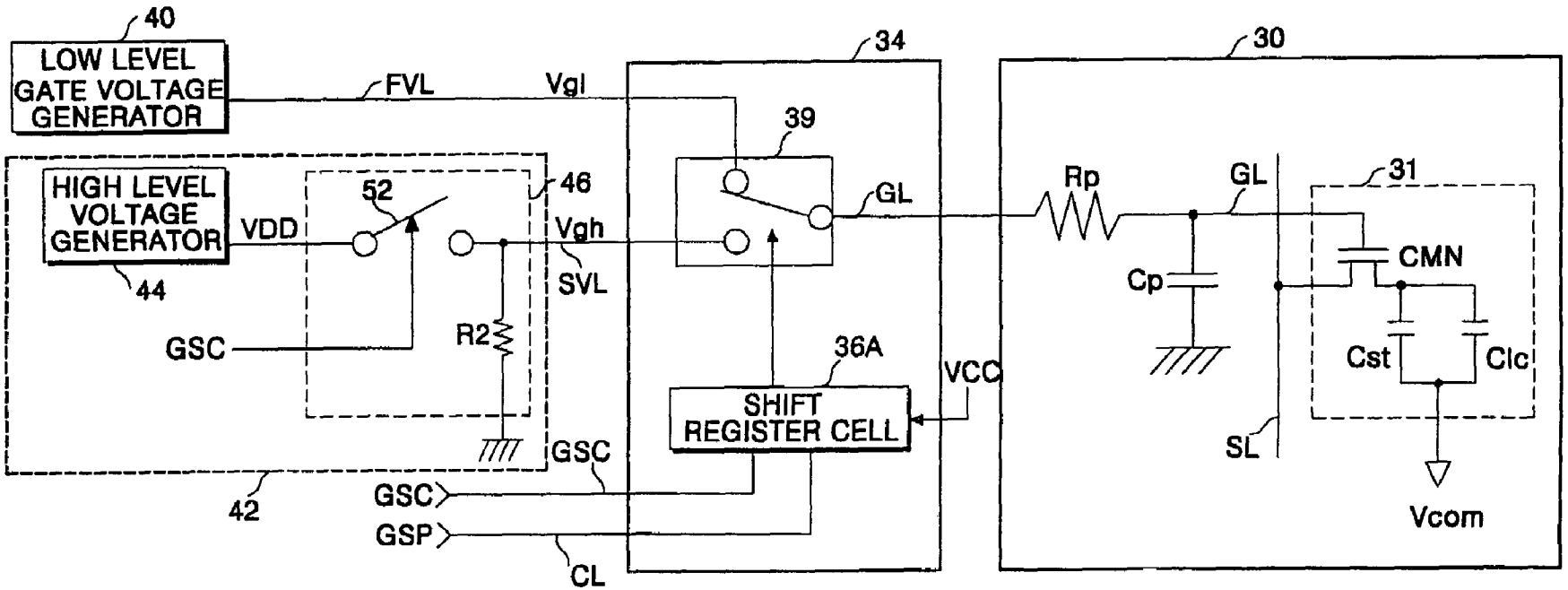
FIG. 10 is a schematic view showing the configuration of a liquid crystal display device according to still another embodiment of the present invention.

Referring to FIG. 10, there is shown an active matrix liquid crystal display device according to still another embodiment of the present invention. The active matrix liquid crystal display device of FIG. 10 has the same circuit configuration similar as that of FIG. 9 except that a resistor R2, instead of the TFT MN, is connected between the second voltage line SVL and the ground voltage line GVL. When a one-contact control switch 52 is turned on with the aid of a high logic of a gate scanning clock GSC, the resistor R2 prevents a leakage of a voltage to be charged in the second voltage line SVL and a gate line GL. Otherwise, when the one-contact control switch 52 is turned off, the resistor R2 lengthens a time when voltages at the second voltage line SVL and the gate line GL are discharged into the ground voltage line GVL, thereby slowly changing the falling edges of a high level gate voltage Vgh and a scanning signal SCS into an exponential function shape. In other words, the resistor R2 increases a time constant of the second voltage line SVL and the gate line GL when the one-contact control switch 52 is turned on. Accordingly, the falling edge of the high level gate voltage Vgh at the second voltage line SVL has a slower slope than the rising edge thereof as shown in FIG. 8. Also, the falling edge of the scanning signal SCS at the gate line GL changes more slowly than the rising thereof as shown in FIG. 8. The falling edges of the high level gate voltage Vgh and the scanning signal SCS are controlled more slowly than the rising edges thereof as described above, so that the liquid crystal display device can suppress a feed through voltage. ΔVp sufficiently and have a rapid response speed.

Moreover, in the active matrix liquid crystal display device according to the embodiments of the present invention as shown in FIG. 5, FIG. 7, FIG. 9 and FIG. 10, the switching operation of the voltage controller 46 is controlled, so that the timing controller 48 in FIG. 4 can be eliminated. As a result, the circuit configuration of the liquid crystal display device according to the embodiments shown in FIG. 5, FIG. 7, FIG. 9 and FIG. 1*b* can be still more simplified. Further, in the active matrix liquid crystal display device according to the embodiments of the present invention, a duty cycle of the gate scanning clock has been expressed as 50%, but it may be controlled suitably in a range in which a voltage can be sufficiently charged in the liquid crystal cell.

Figure 11A:
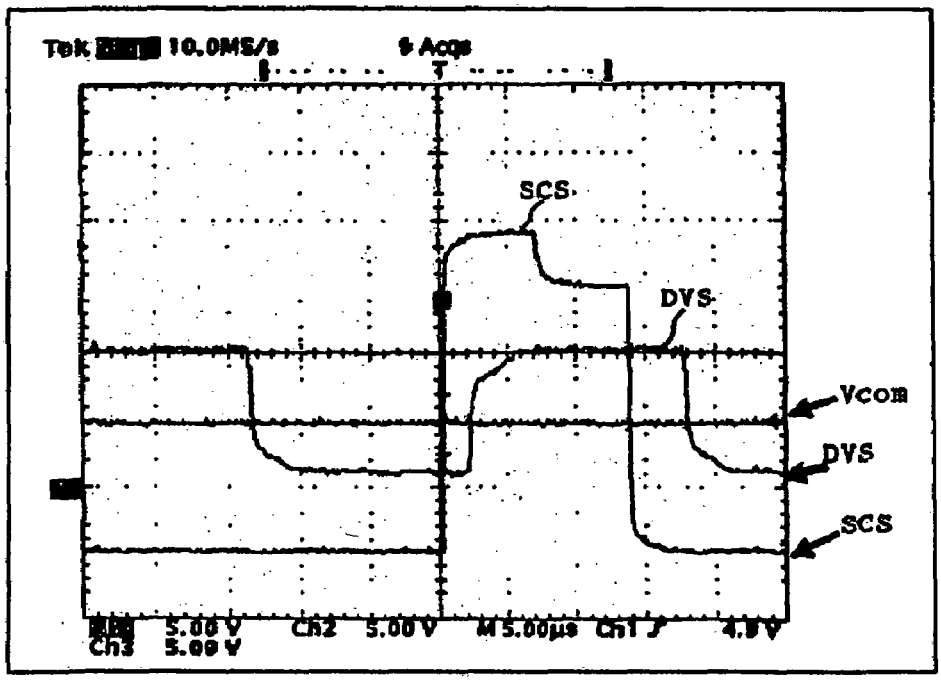
FIG.11A PRIOR ART
FIG. 11A is waveform diagrams of a scanning signal and a data voltage signal each developed on gate line and signal line of the liquid crystal display device disclosed in U.S. Pat. No. 5,587,722.
Figure 11B:
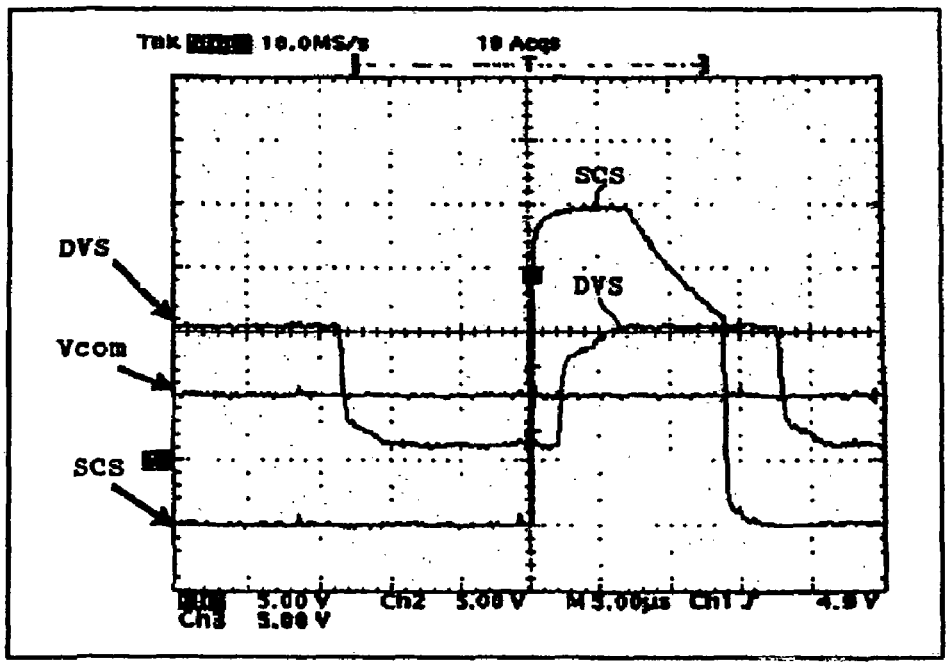
FIG. 11B is waveform diagrams of a scanning signal and a data voltage signal each developed on gate line and signal line of the liquid crystal display device according to the present invention.

FIG. 11A shows a scanning signal SCS and a data voltage signal DVS each developed on gate line GL and signal line SL of the active matrix liquid crystal display device disclosed in U.S. Pat. No. 5,587,722. FIG. 11B shows a scanning signal SCS and a data voltage signal DVS each developed on gate line GL and signal line SL of the active matrix liquid crystal display device according to the present invention. In FIG. 11A, the scanning signal SCS is vary larger than that of the data voltage signal DVS in the voltage level at its falling edge. While, the voltage level of the scanning signal SCS shown in FIG. 11B approaches to the voltage level of the data voltage signal DVS at the falling edge of the scanning signal SCS. Therefore, in the active matrix liquid crystal display device according to the present invention, the feed through voltage ΔVp can be suppressed and the response speed is enhanced.

Figure 12:
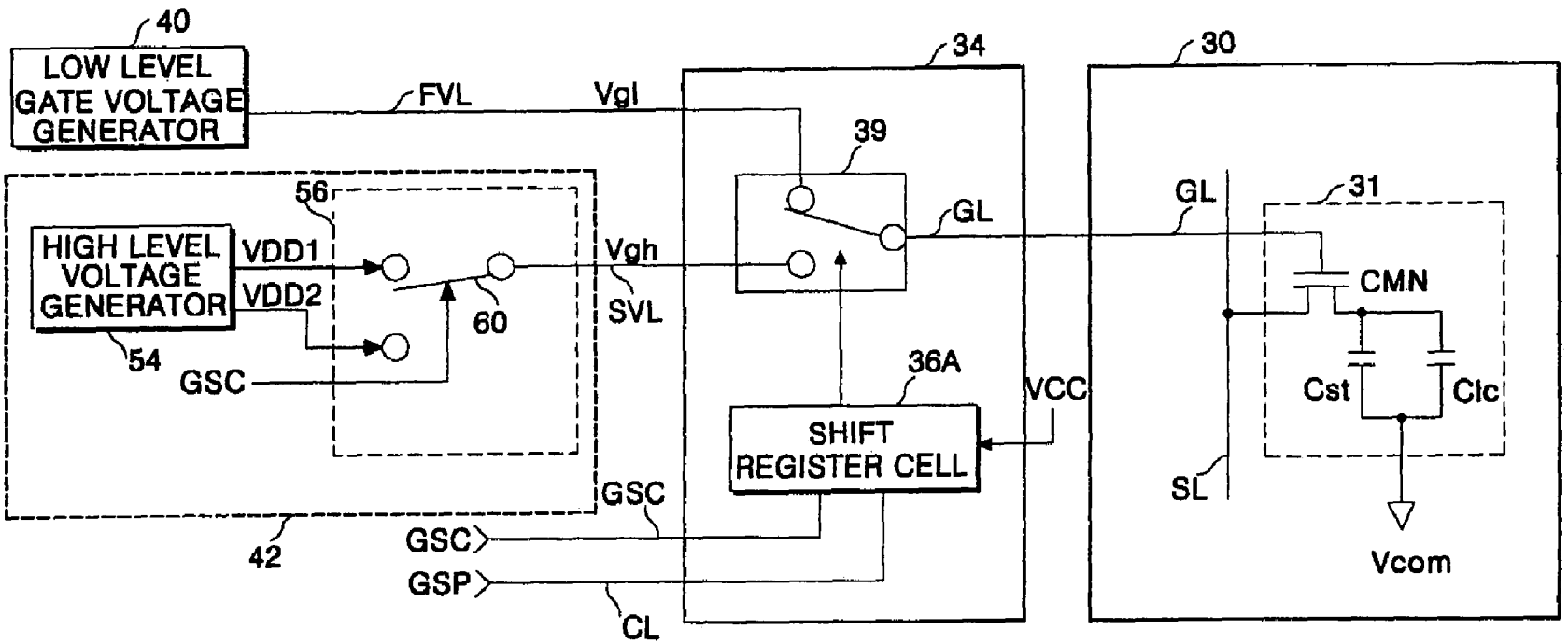
FIG. 12 is a schematic view showing the configuration of a liquid crystal display device according to still another embodiment of the present invention.
Figure 13:
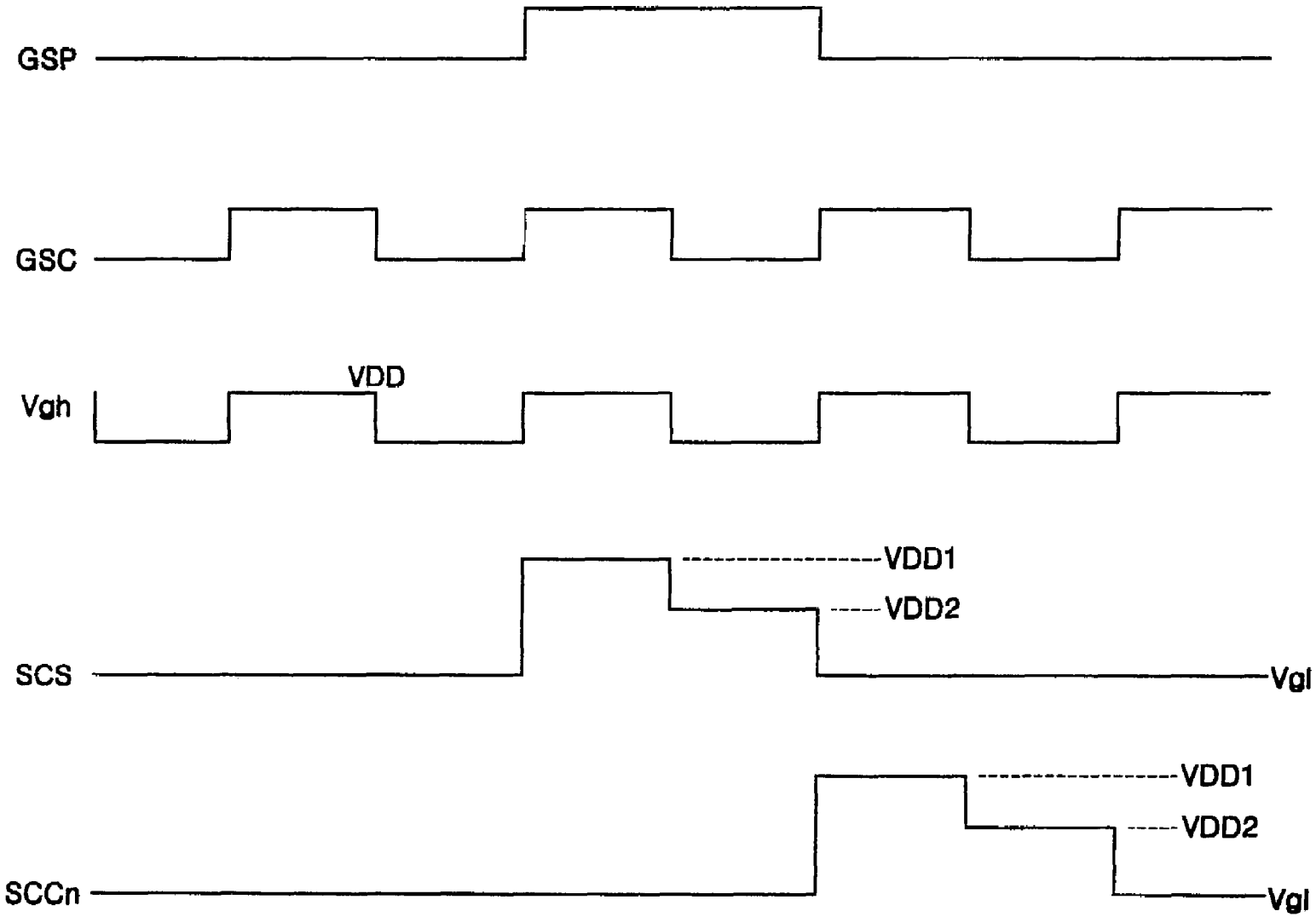
FIG. 13 is output waveform diagrams of each part of the liquid crystal display device shown in FIG. 12.

FIG. 12 illustrates an active matrix liquid crystal display device according to an another embodiment of the present invention. The active matrix liquid crystal display device of FIG. 12 includes a low level gate voltage generator 40 and a high level gate voltage generator 42 each connected with a first voltage line FVL and a second voltage line SVL. The low level gate voltage generator 40 applies a low level gate voltage Vgl maintaining a constant voltage level to a controlled switch 39 connected to the first voltage line FVL. The high level gate voltage generator 42 generates a pulse shape of a high level gate voltage Vgh which a first high level voltage is alternated with a second high level voltages, as shown FIG. 13. In order to generate the high level gate voltage Vgh, the high level gate voltage generator 42 is composed of a high level voltage generator 54 for generating the first and second high level voltages VDD1 and VDD2 and a voltage controller 56 connected between the high level voltage generator 56 and the second voltage line SVL. The first high level voltage VDD1 generated in the high level voltage generator 54 maintains stably a constant voltage level, and the second high level voltage VDD2 has a constant voltage level between the first high level voltage and the low level gate voltage. The first and second high level voltages VDD1 and VDD2 are applied to the voltage controller 56. The voltage controller 56 supplies alternatively the first and second high level voltages to the second voltage line SVL such that the high level gate voltage Vgh as shown in FIG. 13 is developed on the second voltage line SVL. The voltage controller 56 includes a second controlled switch 58 responding to a gate scanning clock GSC. During the high logic period of the gate scanning clock GSC, the second controlled switch 58 supplies the first high level voltage VDD1 to the second voltage line SVL, thereby appearing the first high level voltage Vgh on the second voltage line SVL. In the other hand, the second controlled switch 58 applies the second high level voltage VDD2 to the second voltage line SVL to develop the second high level voltage VDD2 on the second voltage line SVL, at the low logic period of the gate scanning clock GSC. As a result, the high level gate voltage Vgh has sequentially the first and second high level voltages VDD1 and VDD2 every the period of the gate scanning clock GSC.

In the active matrix liquid crystal display device of FIG. 12, there is included a gate driver 34 for driving gate lines GL on the liquid crystal panel 30. The liquid crystal panel 30 has pixels 31 each connected with the signal line SL and the gate line. Each of the pixels 31 consists of a liquid crystal cell Clc for controlling a amount of lights passed through its own responding to the data voltage signal DVS from the signal line SL, and a TFT for responding to the scanning signal SCS to switch the data voltage signal DVS to be supplied to the liquid crystal cell Clc. In the pixel, a additional capacitor Cst is also connected with the liquid crystal cells Clc in the parallel. The gate driver 34 is composed of a shift register cell 36A for responding to a gate start pulse GSP from a control line CL and the gate scanning clock GSC from the gate clock line GCL, and the first controlled switch 39 connected between the shift register cell 36A and the gate line GL1. The shift register cell 36A outputs the gate start pulse GSP to its output terminal QT at the raising edge of the gate scanning clock GSC. Then, in the gate line GL1, there is developed a scanning signal SCS having the low level gate voltage Vgl or the high level gate voltage Vgh. In detail, the first controlled switch 39 applies sequentially the first and second high level voltages VDD1 and VDD2 during the high logic period of the output signal from the shift register cell 39A, while applies the low level gate voltage Vgl to the gate line GL1 when the output signal of the shift register cell 36A go to the low logic. As a result, the scanning signal as shown in FIG. 13, varied in a stepwise shape, is generated on the gate line GL1. A SCSn shows a wave form of a scanning signal to be applied to a next gate line.

since the scanning signal SCS is varied in stepwise, the TFT CMN is turned off when the voltage of the scanning signal from the gate line GL1 drops into a voltage level lower than its threshold voltage. Then, although the charges in the liquid crystal cell Clc included in the pixel 31 is pumped toward the gate line GL1, the fully charges are charged in the liquid crystal cell Clc by the data voltage signal DVS from the signal line SL through the TFT CMN. Therefore, a voltage charged in the liquid crystal cell Clc doesn't drop down. In the case the high level gate voltage Vgh drops down the threshold voltage of the TFT CMN, it is small the charges pumped from the liquid crystal cell to the gate line GL1 because a maximum value of a voltage variation on the gate line GL1 becomes the threshold voltage of the TFT CMN. As a result, the feed through voltage ΔVp is fully suppressed, furthermore a flicker and residual image doesn't appear on a picture point displayed by the pixel 31.

In FIG. 12, the parasitic resistor Rp and the parasitic capacitor Cp as shown in FIG. 4, existed on the gate line GL1, affects to the high level gate voltage Vgh. With this view, the parasitic resistor Rp and the parasitic capacitor Cp had been eliminated from FIG. 12.

Figure 14:
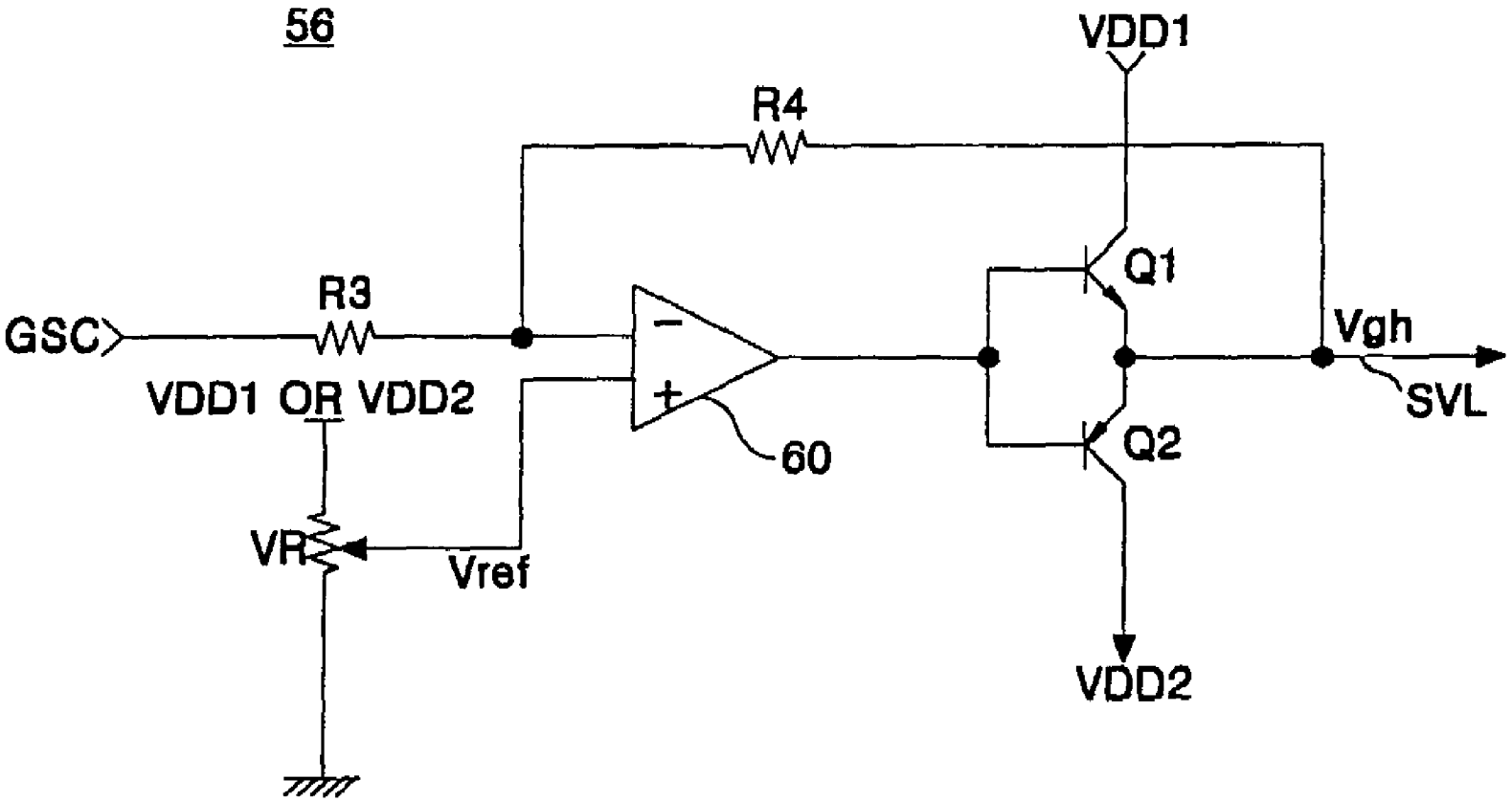
FIG. 14 is a schematic view showing another embodiment of the voltage controller shown in FIG. 12.
Figure 15:
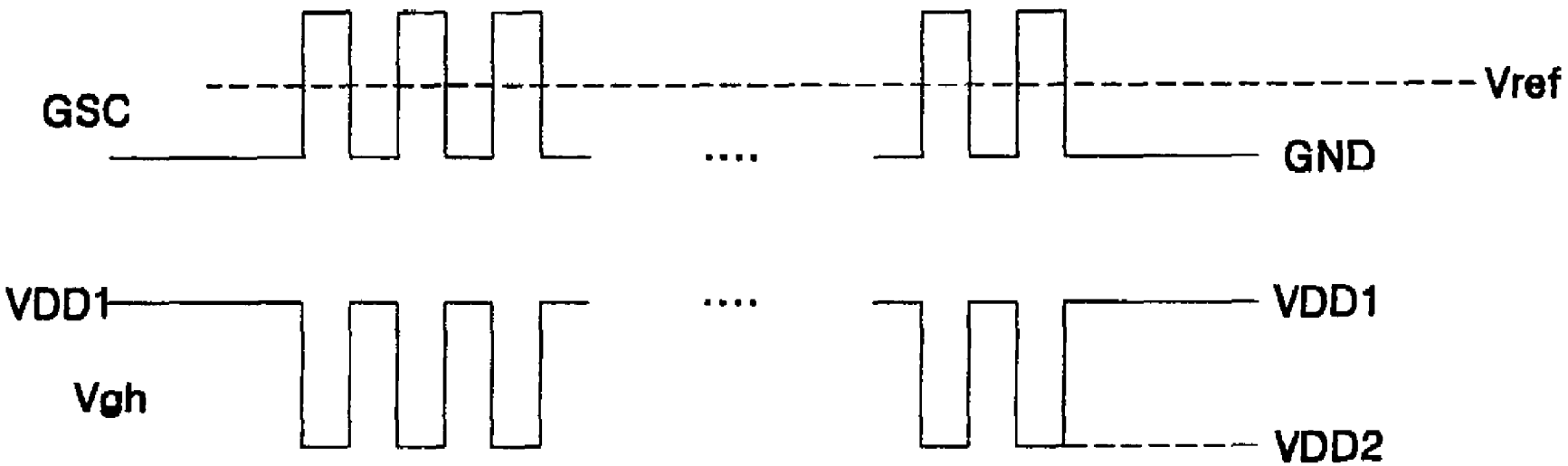
FIG. 15 is an input and output waveform diagrams of the voltage controller shown in FIG. 14.

FIG. 14 illustrates another embodiment of the voltage controller 56 as shown in FIG. 12. The voltage controller 56 of FIG. 14 includes a comparator 60 for receiving the gate scanning clock GSC to its invert terminal "−" through a resistor R3, and first and second transistors Q1 and Q2 for responding complimentarily to the output signal of the comparator 60. The comparator 60 compares a reference voltage Vref from a variable resistor VR with the gate scanning clock GSC as shown in FIG. 15, and generates a comparison signal having a logic state according to a comparison resultant. In detail, the comparator 60 applies a low logic of the comparison signal to the base terminals of the first and second transistors Q1 and Q2 in case that the reference voltage Vref is higher than the gate scanning clock GSC. On the other hand, if the reference signal is lower than the gate scanning clock GSC, the comparator 60 supplies a high logic of the comparison signal to the base terminals of the first and second transistors Q1 and Q2. Then, the reference voltage Vref from the variable resistor VR divides a voltage difference between the first or second high level voltage VDD1 or VDD2 and a ground voltage GND, and applies the divided voltage to the non-invert terminal "+" of the comparator 60 as the reference voltage Vref. The first transistor Q1 applies the first high level voltage VDD1 from the high level voltage generator 54 of FIG. 12 to the second voltage line SVL, during the high logic period of the comparison signal from the comparator 60, while the second transistor Q2 supplies the second high level voltage VDD2 from the high level voltage generator 54 to the second voltage line SVL in the low logic interval of the comparison signal from the comparator 60. Therefore, on the second voltage line SVL, it is developed the high level gate voltage signal Vgh varying in the complementary with the gate scanning clock GSC. The high level gate voltage Vgh has alternatively the first and second high level voltages VDD1 and VDD2 in response with the gate scanning clock GSC. Also, the high level gate voltage Vgh is used to a liquid crystal display device which the shift register cell 36A is responds to the falling edge of the gate scanning clock GSC. Furthermore, the high level gate voltage Vgh has an equal shape with the gate scanning clock GSC in case that these are changed the first and second transistors Q1 and Q2 or the reference voltage and the gate scanning clock GSC to be each applied to the invert and non-invert terminals "−" and "+" of the comparator 60. Meanwhile, a resistor R4, connected between the second voltage line SVL and the invert terminal "−" of the comparator 60, feeds back a voltage on the second voltage line SVL to the invert terminal "−" of the comparator 60, such that the high level gate voltage Vgh responds rapidly to the gate scanning clock GSC.

Figure 16:
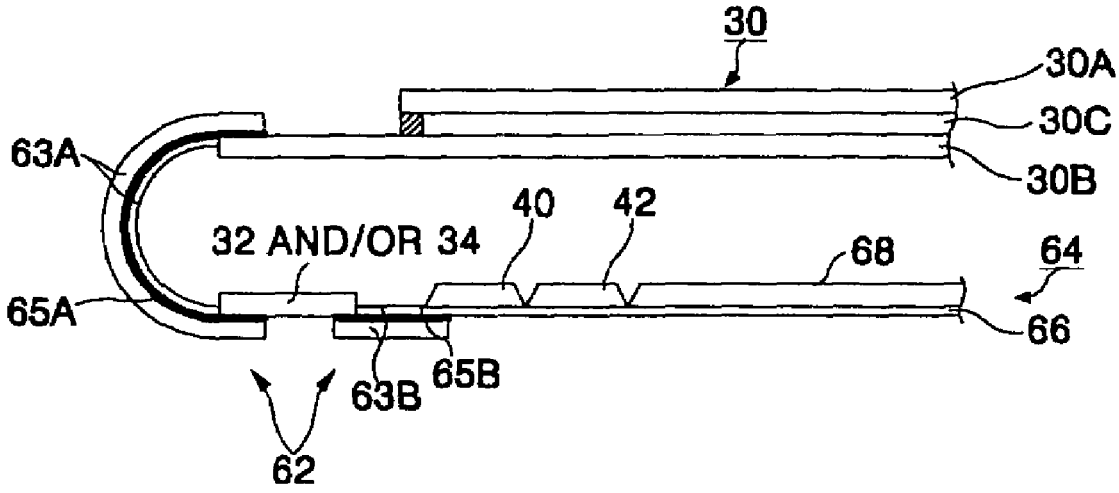
FIG. 16 shows a tab type of liquid crystal display device according to the present invention.

FIG. 16 shows a tab type of liquid crystal display device according to the present invention. In the tab type of the liquid crystal display device shown in FIG. 16, a liquid crystal panel is provided with a liquid crystal layer 30C sealed between an upper glass substrate 30A and a lower glass substrate 30B. The liquid crystal panel 30 is connected with a PCB (Printed Circuit Board) module 66 by a FPC (Flexible Printed Circuit) film 62. The PCB module 66 has a control circuit 68, a low level gate voltage generator 40 and a high level gate voltage generator 42. The FPC film 62 has one end connected with the pad area of the lower glass substrate 30B, and another end coupled with the edge of the under surface of the PCB module. In the intermediate portion of the FPC film, date drivers 32 and/or gate drivers 34 are installed. The data drivers 32 and/or the gate drivers 34 are connected with the liquid crystal panel 30 and the PCB module 64 by the FPC film 62. The FPC film 62 has a first conductive layer pattern 63A connecting the liquid crystal panel 30 with the data drivers 32 and/or the gate drivers 34, and a second conductive layer pattern 63B coupling electrically the data drivers 32 and/or the gate drivers 34 and the PCB module 64. The first and second conductive layer patterns 63A and 63B are each surrounded with first and second protective films 65A and 65B in such a manner that both ends of the first and second conductive layer patterns 63A and 63B are exposed to.

Figure 17:
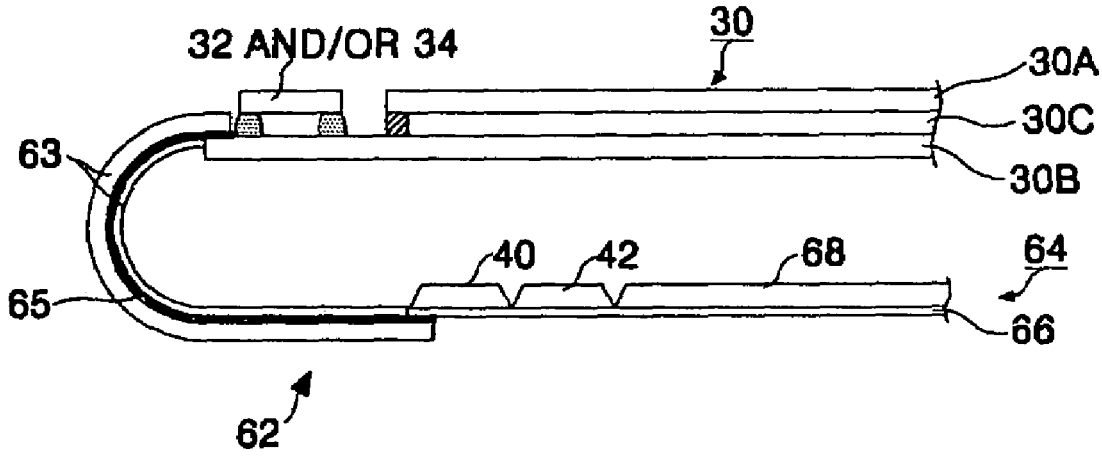
FIG. 17 shows a GOG type of liquid crystal display device according to the present invention.
Figure 18:
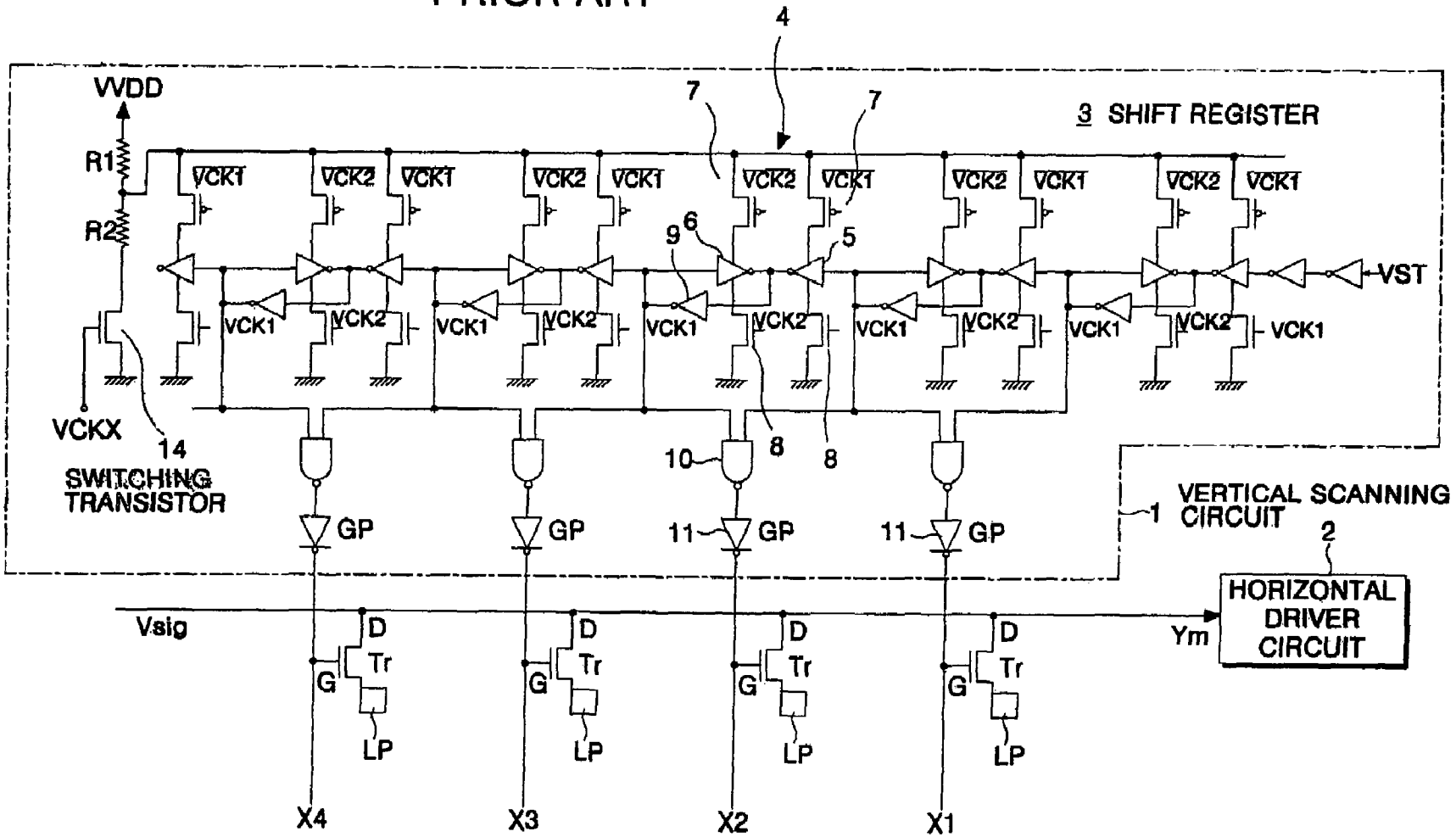
FIG. 18 PRIOR ART
FIG. 18 is a schematic view showing the configuration of a conventional liquid crystal display device.

FIG. 17 shows a COG (Chips On Glass) type of liquid crystal display device according to the present invention. In the COG type of the liquid crystal display device shown in FIG. 16, a liquid crystal panel is provided with a liquid crystal layer 30C sealed between an upper glass substrate 30A and a lower glass substrate 30B. The liquid crystal panel 30 is connected with a PCB module 66 by a FPC (Flexible Printed Circuit) film 62. The PCB module 66 has a control circuit 68, a low level gate voltage generator 40 and a high level gate voltage generator 42 loaded thereon. Data drivers 32 and/or gate drivers 34 are mounted on the pad area of the lower glass substrate 30B. The data drivers 32 and/or the gate drivers 34 are connected with the PCB module 64 by the FPC film 62. The FPC film 62 connects the PCB module 64 with the liquid crystal panel 30 loading with the data drivers 32 and/or the gate drivers 34 thereon. The FPC film 62 has one end connected with the pad area of the lower glass substrate 30B, and another end coupled with the edge of the under surface of the PCB module. The FPC film 62 has a conductive layer pattern 63 connecting electrically the liquid crystal panel 30 with the PCB module 64. The conductive layer pattern 63 is surrounded with a protective film 65 in such a manner that both ends of the conductive layer pattern 63 are exposed to.

As described above, in the active matrix liquid crystal display device according to the present invention, a high level gate voltage is supplied to the level shifter of the gate driver in the alternating current shape, thereby changing the falling edge of the scanning signal into any one of the linear, exponential or ramp function shape. Accordingly, the active matrix liquid crystal display device according to the present invention is capable of suppressing the feed through voltage ΔVp sufficiently as well as preventing an occurrence of flickering and residual images. Furthermore, the active matrix liquid crystal display device according to the present invention has a very simplified circuit configuration.

Moreover, in the active matrix liquid crystal display device according to the present invention, the falling edge of the high level gate voltage has a slower slope than the rising edge thereof, thereby changing the falling edge of the scanning signal to be applied to the gate line more slowly than the rising edge thereof. Accordingly, the active matrix liquid crystal display device according to the present invention is capable of preventing an occurrence of a flicker and a residual image as well as providing a rapid response speed.

Although the present invention has been explained by the embodiments shown in the drawing hereinbefore, it should be understood to the ordinary skilled person in the art that the invention is not limited to the embodiments, but rather than that various changes or modifications thereof are possible without departing from the spirit of the invention. Accordingly, the scope of the invention shall be determined only by the appended claims and their equivalents.

What is claimed is:

1. An active matrix liquid crystal display apparatus, comprising:

a plurality of pixels each including pixel switching transistors having a gate electrode, a first electrode, and a second electrode connected to a pixel electrode;

a plurality of data signal lines each connected to the first electrode associated with any one of the pixel switching transistors;

a plurality of gate signal lines each connected to the gate electrode associated with any one of the pixel switching transistors;

a low level gate voltage generator that supplies a first gate voltage to a gate driver; and a high level gate voltage generator that supplies a second gate voltage to the gate driver, the gate driver including:

a shift register that outputs a control pulse to a level shifter that has a logic state that transitions from a first logic level to a second logic level for each gate line; and the level shifter connected to the plurality of the gate signal lines, said level shifter receiving the first and second gate voltages and outputting the first gate voltage in response to the first logic level of the control pulse and the second gate voltage in response to the second logic level of the control pulse to drive the plurality of gate signal lines sequentially, wherein the high level gate voltage generator reduces the second gate voltage received by the level shifter to a voltage level substantially at a threshold voltage level of the one of the pixel switching transistors but enough to maintain an on-state of the pixel switching transistor until the control pulse supplied to the level shifter has the first logic level and the level shifter outputs the first gate voltage that turns off the one of the pixel switching transistors.

2. The active matrix liquid crystal display apparatus as claimed in claim 1, wherein the high level gate voltage generator reduces the second gate voltage received by the level shifter for exciting a gate signal line prior to exciting the successive plurality of gate signal lines.

3. The active matrix liquid crystal display apparatus as claimed in claim 1, wherein the high level gate voltage generator reduces the second gate voltage received by the level shifter exponentially.

4. The active matrix liquid crystal display apparatus as claimed in claim 1, wherein the high level gate voltage generator reduces the second gate voltage received by the level shifter linearly.

5. The active matrix liquid crystal display apparatus as claimed in claim 1, wherein the high level gate voltage generator reduces the second gate voltage received by the level shifter stepwise.

6. The active matrix liquid crystal display apparatus as claimed in claim 1, wherein a minimum value of the second gate voltage received by the level shifter from the high level gate voltage generator is higher than a maximum value of the first gate voltage.

7. The active matrix liquid crystal display apparatus of claim 1, the high level gate voltage generator comprising, a high level voltage source providing a high level voltage, and a voltage controller receiving the high level voltage and providing the second gate voltage having the voltage level reduced substantially to the threshold voltage level prior to excitation of a successive gate signal line.

8. The active matrix liquid crystal display apparatus of claim 7, wherein the voltage controller comprises a switch switching the second gate voltage between the high level voltage and a fixed voltage prior to excitation of the successive gate signal line.

9. The active matrix liquid crystal display apparatus of claim 8, wherein the fixed voltage is ground.

10. The active matrix liquid crystal display apparatus of claim 7, wherein the gate driver includes a switch connected to an output of the high level gate voltage generator, said switch selectively providing the first gate voltage and the second gate voltage to the plurality of the gate signal lines.

11. The active matrix liquid crystal display apparatus of claim 7, further comprising a low level gate voltage generator providing the first gate voltage to the gate driver.

12. The active matrix liquid crystal display apparatus of claim 11, wherein the gate driver includes a switch connected to an output of the high level gate voltage generator and an output of the low level gate voltage generator, said switch switching between the output of the low level gate voltage generator and the output of the high level gate voltage generator to provide the first and second gate voltage signals respectively to the plurality of the gate signal lines.

13. A method of driving an active matrix liquid crystal display apparatus including pixels defined by gate lines and signal lines, pixel switching transistors connected to the gate lines and the signal lines, and a gate driver connected to the gate lines and having a shift register, said method comprising:

generating a first gate voltage and a second gate voltage, the first gate voltage having a voltage level that turns off the pixel switching transistors and the second gate voltage having a voltage level that turns on the pixel switching transistors; and supplying the first gate voltage and the second gate voltage to a selecting device that selectively outputs the first and second voltages to the gate lines, said selecting device being controlled by the shift register to select between the first gate voltage and the second gate voltage and reducing a voltage level of the second gate voltage supplied to the selecting device substantially to a threshold voltage level but enough to maintain an on-state of the pixel switching transistors during a period while the selecting device selects the second gate voltage until the selecting device is controlled to select the first gate voltage.

14. The method as claimed in claim 13, wherein the second gate voltage is supplied to the gate lines during a time interval when the pixel switching transistors connected to the gate lines are turned on.

15. The method as claimed in claim 13, wherein the shift register operates at a driving voltage having a logical voltage level.

16. A liquid crystal display (LCD) device, comprising:

a plurality of pixels arranged in rows and columns, each pixel including, a pixel electrode, and a pixel switching device having a gate electrode, a first electrode, and a second electrode connected to the pixel electrode;

a plurality of data signal lines each connected to the first electrode of the pixel switching device of each pixel in one of the columns;

a plurality of scanning signal lines each connected to the gate electrode of the pixel switching device in one of the rows; and a gate driver connected to the plurality of scanning signal lines, said gate driver receiving first and second gate voltages and a scanning clock signal and, in response to the scanning clock signal, successively outputting second gate voltage to the scanning signal lines to drive the scanning signal lines, wherein the pixel switching device responds to the first gate voltage to disconnect the first electrode from the pixel electrode, and responds to the second gate voltage to connect the first electrode to the pixel electrode, wherein a voltage level of the second gate voltage received by the gate driver changes during a period of the scanning clock signal prior to the gate driver selecting a successive scanning signal line, and wherein the voltage level of the second gate voltage turns on the switching device and the voltage level of the second gate voltage is reduced substantially to a threshold voltage level but enough to maintain an on-state of the pixel switching device during the period of the scanning clock signal until a time when the gate driver selects the successive scanning signal line.

17. The LCD device of claim 16, further comprising:

a high level gate voltage generator providing the second gate voltage to the gate driver, the high level gate voltage generator comprising;

a high level voltage source providing a high level voltage, and a voltage controller receiving the high level voltage and providing the second gate voltage having the voltage level reduced substantially to the threshold voltage level prior to excitation of the successive scanning signal line.

18. The LCD device of claim 17, wherein the voltage controller comprises a switch switching the second gate voltage between the high level voltage and a fixed voltage prior to the gate driver driving the successive scanning signal line.

19. The LCD device of claim 17, wherein the gate driver includes a control switch connected to an output of the high level gate voltage generator, said switch selectively providing the first gate voltage and the second gate voltage to the plurality of scanning signal lines.

20. The LCD device of claim 19, further comprising a low level gate voltage generator that provides the first gate voltage to the gate driver.

21. A method of driving a liquid crystal display device, having a plurality of pixel switching transistors, each switching transistor having a gate electrode, a first electrode, and a second electrode, and a pixel electrode, the method comprising:

providing a plurality of signal lines and a plurality of scanning lines that are arranged in a matrix pattern, wherein the plurality of signal lines connect to the plurality of first electrodes, and wherein the plurality of scanning lines connect to the plurality of gate electrodes;

sequentially applying a first voltage to each of the plurality of scanning lines, wherein the first voltage electrically disconnects the plurality of first electrodes from the plurality of pixel electrodes; and sequentially applying a second voltage to each of the plurality of scanning lines, wherein the second voltage electrically connects the plurality of first electrodes to the plurality of pixel electrodes, wherein the first voltage is sequentially applied to each of the plurality of scanning lines after the application of the second voltage to each of the plurality of scanning lines but prior to the sequential application of the second voltage to another one of the plurality of scanning lines, said second voltage reducing a gate voltage level substantially to a threshold voltage level but enough to maintain a connection between the first electrode to the pixel electrode until applying the first voltage.

22. The method of driving according to claim 21, wherein the second voltage is greater than the first voltage.

23. The method of driving according to claim 21, wherein the second voltage reduces the gate voltage level exponentially.

24. The method of driving according to claim 21, wherein the second voltage reduces the gate voltage level linearly.

25. The method of driving according to claim 21, wherein the second voltage reduces the gate voltage level stepwise.

26. The method of driving according to claim 21, further comprising:

generating the first voltage using a first voltage source;

generating the second voltage using a second voltage source; and applying the first and second voltage to the plurality of scanning lines using a switch, the switch being selectively connectable to both the first and second voltage sources, wherein the switch connects to the first and second voltage sources prior to the application of the second voltage to a successive one of the plurality of scanning lines.

27. An active matrix liquid crystal display apparatus, comprising:

a pixel having a pixel electrode and a pixel switching transistor, the pixel switching transistor including a gate electrode, a source electrode, and a drain electrode connected to the pixel electrode;

a data signal line connected to the source electrode;

a gate signal line connected to the gate electrode;

a gate driver connected to the gate signal line;

a high level gate voltage generator and a low level gate voltage generator electrically connected to the gate driver and outputting first and second voltage levels to the gate driver, respectively, wherein the gate driver outputs a gate signal sequentially having the first voltage level and the second voltage level to the gate line, the high level gate voltage generator including circuitry for reducing the second voltage level output to the gate driver substantially to a threshold voltage of the pixel switching transistor that maintains the pixel switching transistor on while the gate driver outputs the second voltage level of the gate signal until the gate driver outputs the first voltage level of the gate signal; and a data driver connected to the data signal line for applying a data signal to the data signal line.

28. The active matrix liquid crystal display apparatus as claimed in claim 27, wherein a falling edge of the reduced second voltage level has one of a linear, an exponential, a step and a ramp function shape.

29. The active matrix liquid crystal display apparatus as claimed in claim 28, wherein a falling edge of the reduced second voltage level has a slower slope than a rising edge of the gate signal.

30. The active matrix liquid crystal display apparatus as claimed in claim 27, wherein a falling edge of the reduced second voltage level has a slower slope than a rising edge of the gate signal.

31. The active matrix liquid crystal display apparatus as claimed in claim 27, wherein the gate signal line further includes a parasitic resistor and a parasitic capacitor.

32. The active matrix liquid crystal display apparatus as claimed in claim 31, wherein a falling edge of the reduced second voltage level has one of a linear, an exponential, a step and a ramp function shape.

33. The active matrix liquid crystal display apparatus as claimed in claim 27, wherein the high level gate voltage generator together with the parasitic resistor and the parasitic capacitor modulate the second voltage level of the gate signal.

* * * * *